US006164114A

United States Patent [19]

Pelech, Jr.

[11] Patent Number: 6,164,114

[45] Date of Patent: Dec. 26, 2000

[54] COMPENSATION DEVICE FOR A PRESS BRAKE

[76] Inventor: Bruno J. Pelech, Jr., 17350 Antler Dr., Orland Park, Ill. 60467

[21] Appl. No.: 09/413,913

[22] Filed: Oct. 4, 1999

[51] Int. Cl.[7] ..... B21D 5/02

[52] U.S. Cl. ..... 72/389.4; 72/482.4

[58] Field of Search ..... 72/389.4, 389.5, 72/462, 482.4, 482.1, 465.1

[56] References Cited

U.S. PATENT DOCUMENTS

| | | | |
|---|---|---|---|
| 4,426,873 | 1/1984 | Pearson et al. | 72/389.4 |
| 4,449,389 | 5/1984 | Cros | 72/389.4 |
| 4,736,612 | 4/1988 | Russell | 72/389.4 |
| 4,898,015 | 2/1990 | Houston | 72/389.4 |

*Primary Examiner*—David Jones
*Attorney, Agent, or Firm*—Cherskov & Flaynik

[57] ABSTRACT

A compensation device (10) for a press brake that provides vertical arcuate adjustment to a die holding an elongated workpiece to be configured by the press brake. The compensation device (10) includes a die holder member (18) that removably receives the die, an elongated wedge (14) having an inclined upper surface (60) that congruently engages an inclined lower surface (82) of the die holder member (18), and a press bed engagement member (12) that supports the wedge (14) and positions the die holder member (18) such that the wedge (14) is capable of lateral movement relative to the die holder member (18) thereby arcuately elevating the combined die holder member (18), die and workpiece by adjusting one wedge deformation bolt (76). The arcuately elevated workpiece prevents incomplete bends or "flat spots" from occurring in a mid-portion of the workpiece due to an overloaded or relatively "long" press bed in the press brake. The device (10) further includes the capability of determining the amount of elevation of the die holder member (18) by utilizing a "feeler gauge" to measure the lateral dimension of a gap (102) vertically separating the die holder member (18) and the press bed engagement member (12).

21 Claims, 21 Drawing Sheets

COMPENSATION DEVICE FOR A PRESS BRAKE

BACKGROUND OF THE INVENTION

1. Field of the Invention

The present invention relates generally to press brakes and, more particularly, to devices that vertically adjust the position of a die in a press brake to ultimately deform a workpiece such that the configuration of end portions of the workpiece are consistent with the configuration of a mid-portion of the workpiece.

2. Background of the Prior Art

It is common practice to use an adjustable bolster between a die and a press bed of a press brake to vary the crown or elevation of the die to obtain consistent bends and angles such that end and mid-portions of a workpiece have the same configurations after the workpiece is bent by a press brake. The adjustable bolster is required to compensate for the downward deflection or "yawning" in the press bed of the press brake caused by excessive use and operating loads. Further, the design of the press brake will influence workpiece inconsistencies and form an incomplete bend or "flat spot" due to deflection of the press bed. The greater the longitudinal dimension of the press bed, the greater the downward deflection in the press bed and the more pronounced the flat spots in the workpiece after operation of the press brake.

Prior art devices utilize a plurality of wedges to ultimately elevate the die to eliminate flat spots. An example of this technique is disclosed in U.S. Pat. No. 4,736,612. The patent teaches the use of multiple bolts and nuts to position each individual wedge members at a respective lateral position to elevate a corresponding wedge section thus positioning a predetermined portion of a die holder member.

One problem with this method of positioning the die holder is that an excessive amount of time is required to rotate all the adjusting bolts and thereby set all the wedges of the device for operation in the press brake, especially with some press brakes having press beds that are twelve feet in length. Another problem is that the initial cost of the device is excessive due to the large quantity of components which correspondingly causes increased time and expense for maintenance and replacement of parts. Still another problem is that time consuming observations and calculation are required to determine the distance each wedge has laterally traveled from its neutral position and the corresponding elevation differences in each of the wedges. Yet another problem is that the elevation of individual wedges reduces the space between the top of the device and the press brake thus limiting the vertical dimension of the die and workpiece.

Another prior art device utilizing a plurality of wedges is disclosed in U.S. Pat. No. 4,898,015. This patent teaches the use of two longitudinal wedges that are forced laterally apart to elevate a die holder set upon the wedges.

The problem with this device is that the dimensioning of the two wedges must be identical to avoid skewing the surface of the die holder which correspondingly "twists" the die and workpiece therein. Another problem is that once the two dies are laterally spaced apart, it is difficult to return the dies to their original positions where adjacent side walls of the wedges become congruently engaged and coplanar with the longitudinal centerline of a recess directly above the engaged side walls in the die holder.

Another problem that pertains to both the aforementioned patents, is that the wedges are forcibly positioned by threaded bolts that insert into bolt receiving orifices in the side walls of the wedges. The wedge side walls have relatively small lateral dimensions compared to the upper and lower surfaces of the wedge. The side wall lateral dimension limits the diameter of the bolt receiving recess therein. This may result in the wedge becoming permanently "bowed" due to extensive use and/or due to the large deforming force being focused upon a relatively small amount of metal which "stretches" the metal beyond its resiliency limits. Deforming the wedge via the wedge's upper surface, avoids permanent bowing and allows the wedge to continually return to a lineal position.

A need exists for a compensation device for a press brake die that includes one wedge having one inclined upper surface with a relatively large recess in the upper surface that receives a member therein that forcibly deforms or bows the wedge by rotating one adjustment bolt.

SUMMARY OF THE INVENTION

It is an object of the present invention to provide a compensation device for a press brake die to overcome many of the disadvantages of the prior art.

A principle object of the present invention is to provide a device that prevents an incomplete bend or flat spot in a workpiece configured in a press brake. A feature of the device is a die holder member having an upper surface arcuately elevated such that a longitudinal mid-portion forms a peak or "crown." An advantage of the device is that the die holder member correspondingly elevates a die removably secured to the member, the die in turn contains the workpiece that is also arcuately positioned such that when configured by the press brake, the workpiece's mid-portion configuration is consistent with the configuration of the end portions of the workpiece.

Another object of the present invention is to provide a device that requires only one adjusting member to set the elevation of the entire upper surface of the die holder member such that a longitudinal arc having a crowned mid-portion is formed. A feature of the device is a threaded deformation bolt that is rotated to adjust the elevation of the upper surface of the die holder member. An advantage of the device is that component costs and device set-up time are reduced.

Still another object of the present invention is to provide a device that includes only one component that engages and elevates the entire die holder member. A feature of the device is an elongated wedge having an inclined upper surface that engages a corresponding inclined lower surface of the die holder member. An advantage of the device is that the device is easier and less expensive to disassemble, repair and reassemble.

Another object of the present invention is to reduce the vertical dimensions of the device. A feature of the device is one elongated wedge having one inclined surface. An advantage of the device is that more vertical space is provided above the press bed in the press brake to correspondingly receive larger dies and workpieces.

A further object of the present invention is to return the elongated wedge to a lineal or "straight" position after deforming the wedge into a bowed configuration to elevate the die holder member. A feature of the device is a relatively large deformation member receiving recess in the upper inclined surface of the elongated wedge. Another feature of the device is that there are no deforming bolt receiving recesses in the side walls of the elongated wedge. An advantage of the device is that the larger upper surface recess, compared to a smaller side wall recess, allows a large deforming force to be focused upon a relatively large mid-portion of the wedge when forcibly deforming the wedge by laterally moving a deformation member snugly inserted in the recess, resulting with the wedge resiliency parameters being maintained within limits which ultimately return the wedge to a straight configuration after "loosening" the deformation bolt.

Yet another object of the present invention is to provide a device that reduces the cost of repair of worn parts due to friction. A feature of the device is a wedge deformation member that snugly inserts into a recess in the elongated wedge, and receives the deformation bolt via a threaded orifice therethrough. An advantage of the device is that there is only one component exposed to substantial wear; the wedge deformation member which is easy and inexpensive to replace.

Another object of the present invention is to allow the elevation of the die holder member to be measured. A feature of the device is a gap between corresponding portions of the die holder member and a press bed engagement member. An advantage of the gap is that its lateral dimension corresponds to the elevation of the die holder member thereby providing the capability of measuring the elevation of any portion of the die holder member by placing a feeler gauge in a corresponding portion of the gap and measuring the lateral distance separating the die holder member and the press bed engagement member.

A further object of the present invention is to allow multiple devices to be utilized with a press brake when more than one crown is required for the preselected workpiece. A feature of the device is the location of the wedge deformation member at a mid-portion of the wedge. An advantage of the wedge deformation member location is that the elongated wedge is easily deformed in a lateral direction through a wide range of wedge longitudinal dimensions thereby allowing flexibility when determining the number of devices to be installed longitudinally across the press bed of the press brake.

Briefly, the invention provides a single adjustment compensator device for a press brake die comprising an elongated wedge; a wedge deformation member; a die holder member having a recess therein for receiving an inclined planar surface of said elongated wedge, said recess having a lateral dimension relatively larger than the lateral dimension of said elongated wedge; a press bed engagement member having a recess therein for receiving a planar surface of said elongated wedge, said recess having a lateral dimension relatively larger than the lateral dimension of said elongated wedge, said elongated wedge, die holder member, and press engagement member having comparable longitudinal dimensions; means for removably securing said deformation member to said elongated wedge; means for securing opposing end portions of said elongated wedge to cooperating end portions of said press bed engagement member and said die holder member; and means for moving said deformation member transversely to said press bed engagement member while said opposing end portions of said elongated wedge are secured to said cooperating end portions of said press bed engagement member and said die holder member.

BRIEF DESCRIPTION OF THE DRAWINGS

The foregoing invention and its advantages may be readily appreciated from the following detailed description of the preferred embodiment, when read in conjunction with the accompanying drawings in which.

DETAILED DESCRIPTION OF THE PREFERRED EMBODIMENT

Figure 1:
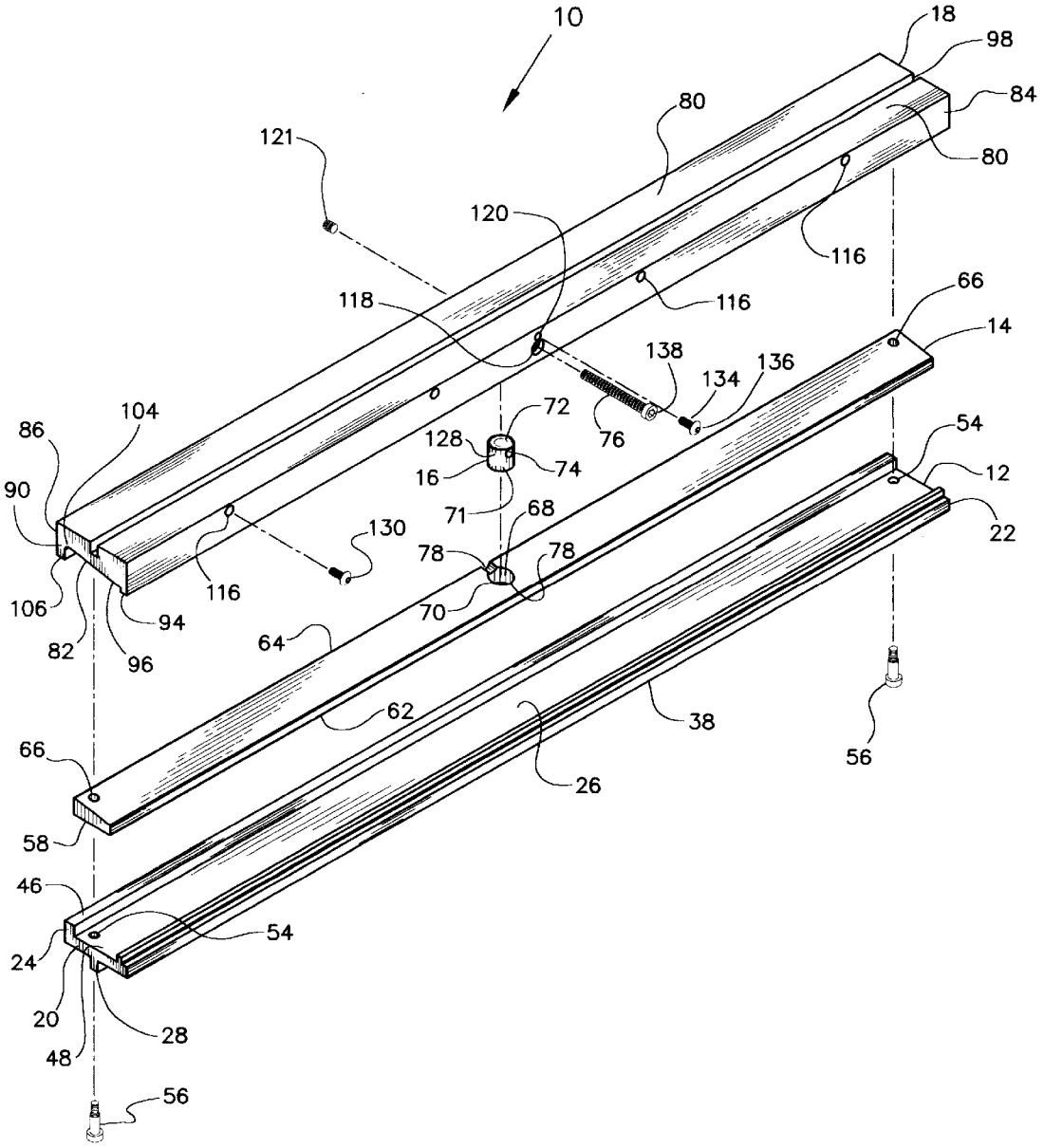
FIG. 1 is an exploded perspective view of a compensation device for a press brake die in accordance with the present invention.
Figure 2:
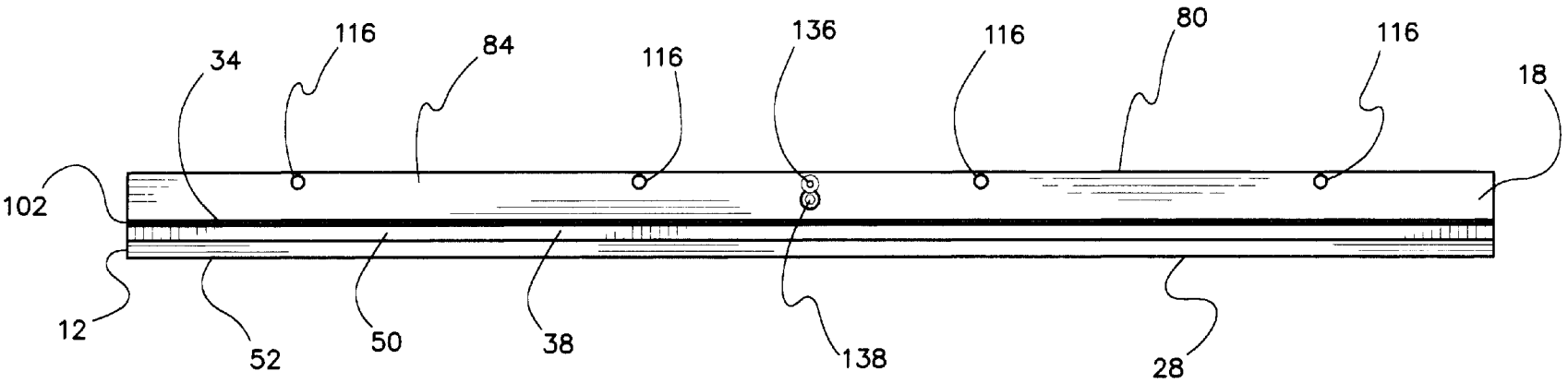
FIG. 2 is a front elevation view of an assembled compensation device for a press brake die in accordance with the present invention.
Figure 3:
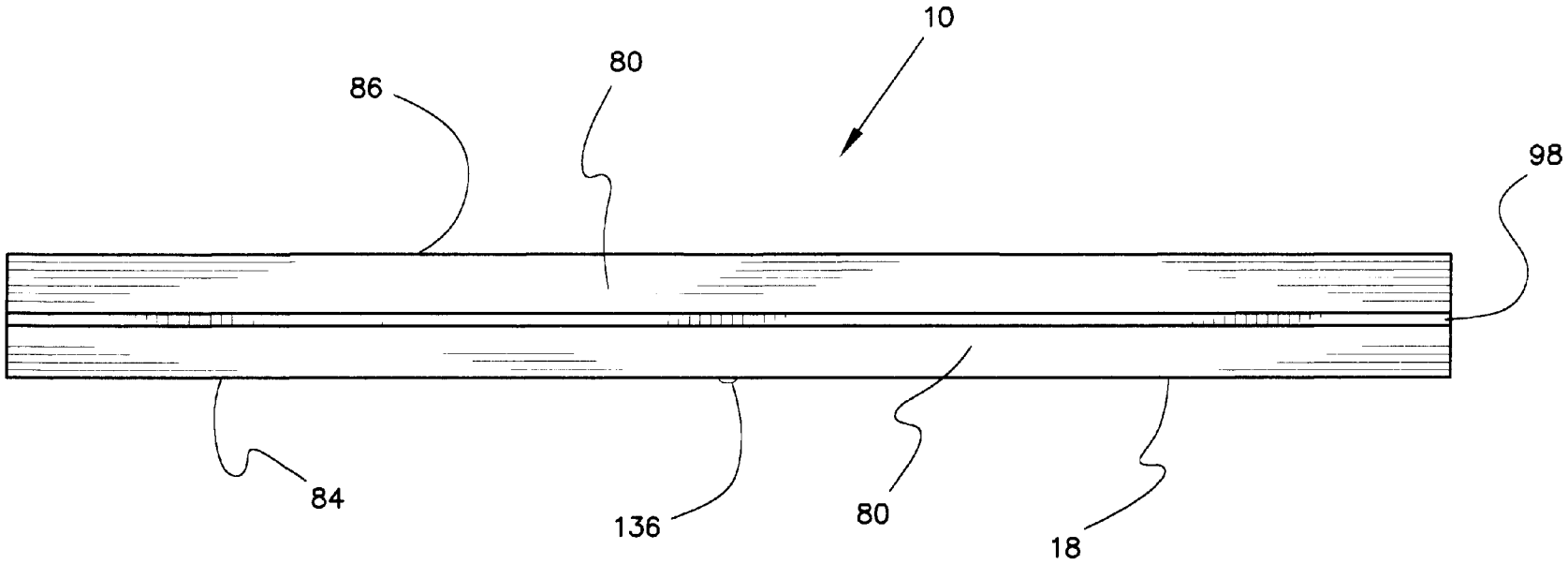
FIG. 3 is a top elevation view of the compensation device depicted in FIG. 2.

Referring now to the figures and in particular to FIGS. 1–5, perspective, front, top, side and back elevation views of an assembled compensating device for a press brake die in accordance with the present invention are depicted. The compensating device 10 is fabricated from metal, preferably 4150 brake die steel and includes a press bed engagement member 12, an elongated wedge 14, a wedge deformation member 16 and a die holder member 18, all cooperating to elevate the die holder member 18 in relation to the press bed engagement member 12. The press bed engagement member is an elongated body of metal having a base member 20, first and second arm members 22 and 24 integrally joined to an upper planar surface 26 of the base member 20, and a locking member 28 integrally joined to a lower planar surface 30 of the base member. The locking member 28 and lower planar surface 30 are cooperatively configured to snugly engage corresponding components of a press bed portion of a press brake (not shown) to stabilize the device 10 during operation of the press brake to configure a workpiece (not shown) inserted in a die (not shown) that is removably received by the die holder member 18 of the device 10.

Referring to FIGS. 4, 11, 12, 13, and 17, the first arm member 22 includes parallel inner and outer walls 32 and 34 that are perpendicular to the upper surface 26, and extend a longitudinal distance equal to that of the base member 20 and a lateral distance that positions an upper wall 36 a relatively small distance from the base member 20 to maintain communication between the outer wall 34 of the first arm member 22 and the die holder member 18 irrespective of the elevated position of the die holder member 18. The outer wall 34 of the first arm member 22 is horizontally displaced from a vertical first side wall 38 of the base member 20 thus forming a ledge 40 upon which a feeler gauge is set to ultimately determine the elevation of the die holder member 18 in relation to the press bed engagement member 12.

The second arm member 24 includes parallel inner and outer walls 42 and 44 that are perpendicular to the upper surface 26, and extend a longitudinal distance equal to that of the base member 20 and lateral distances that position an upper wall 46 a predetermined dimension from the base member 20. The distance separating the upper wall 46 of the second arm member 24 from the upper surface 26 of the base member 20, is relatively larger than the corresponding distance separating the upper wall 36 of the first arm member 22 from the upper surface 26 of the base member 20. The distance separating the upper wall 46 from the upper surface 26 provides continual communication between the outer wall 44 of the second arm member 24 and die holder member 18 irrespective of the elevated position of the die holder member 18 in relation to the press bed engagement member 12. The second arm member 24 is horizontally separated from the first arm member 22 to form a channel or recess 48 having a longitudinal dimension substantially equal to that of the elongated wedge 14, a lateral dimension relatively larger than the lateral dimension of the wedge 14 and a configuration, when taking a side view of the recess 48, that cooperates with the configuration of the wedge 14 to allow the wedge 14 to move laterally across the upper surface 26 of the base member 20 when urged by the wedge deformation member 16.

The locking member 28 is joined to and extends the length of the longitudinal mid-section of the base member 20. The locking member 28 includes two parallel side walls 50 that extend perpendicularly to the lower surface 30 of the base member 20 to form a bottom wall 52. The lateral dimensions of the side and bottom walls 50 and 52 are predetermined to allow the locking member 28 to snugly insert into a receiving recess (not shown) in a press bed (not shown) of the press brake such that the lower surface 30 of the base member 20 engages a corresponding portion of the press bed thereby providing a secure and safe joining of the device 10 with the press bed during the operation of the press brake to configure a workpiece inserted therein.

The press bed engagement member 12 further includes two orifices 54 positioned at opposing end portions of the recess 48, and adjacent to the inner wall 42 of the second arm member 24. The orifices 54 allow corresponding bolts 56 (see FIG. 4B) to be countersunk in and through the base member 20 to ultimately join the press bed engagement member 12 to the elongated wedge 14 and the die holder member 18.

Figure 4:
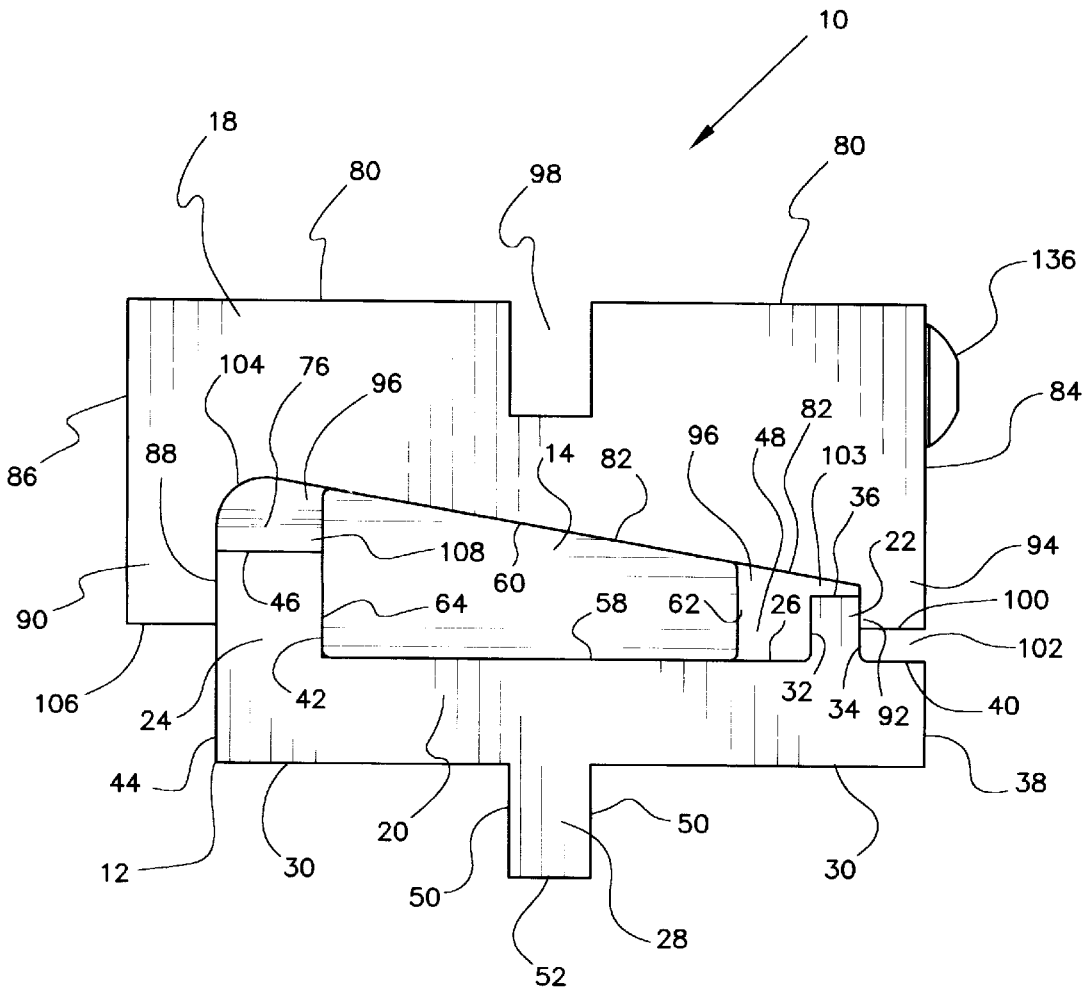
FIG. 4 is a side elevation view of the compensation device depicted in FIG. 2.
Figure 4A:
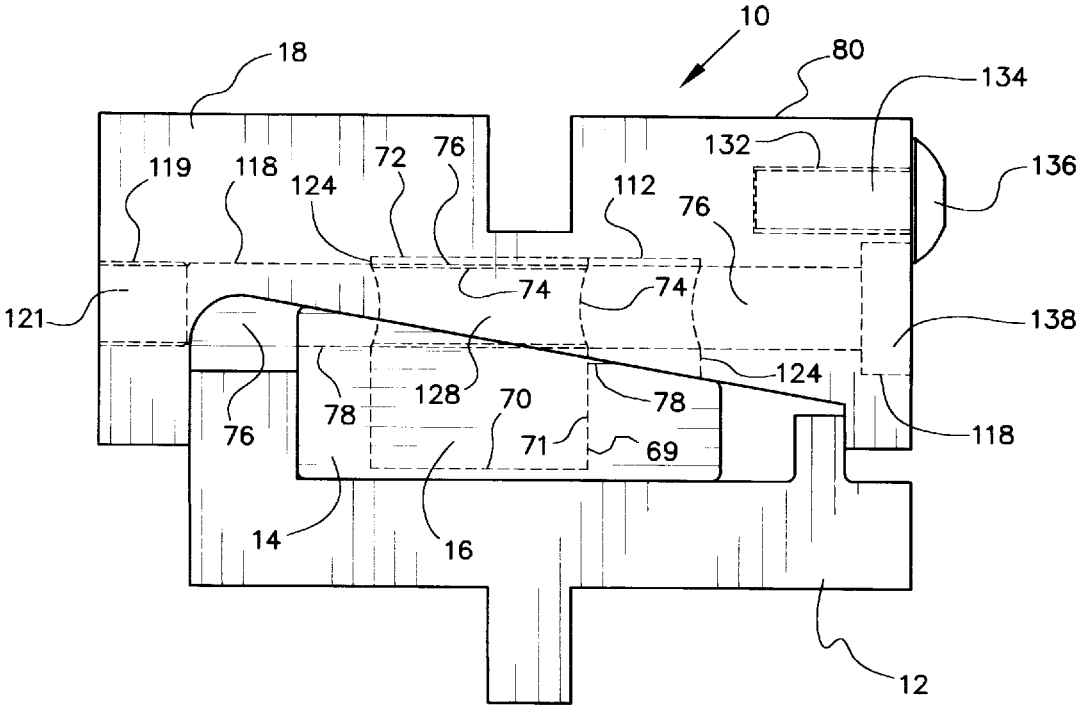
FIG. 4A is a phantom view of FIG. 4 depicting the internal components used to deform an elongated wedge.
Figure 4B:
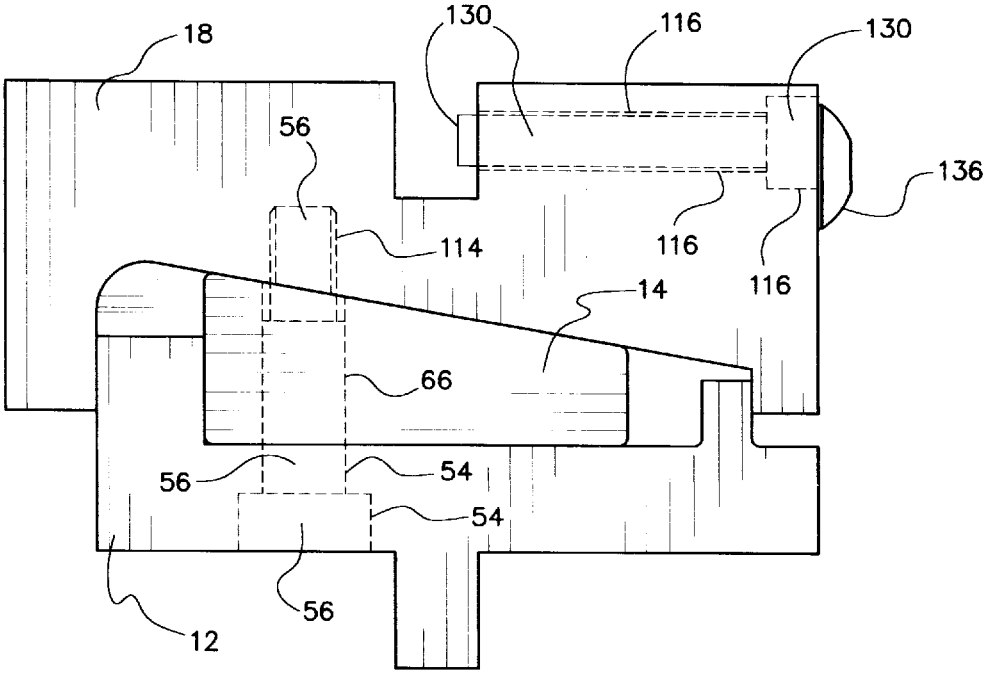
FIG. 4B is a phantom view of FIG. 4 depicting the bolts used to secure opposing ends of the device and a die inserted in the device.
Figure 5:
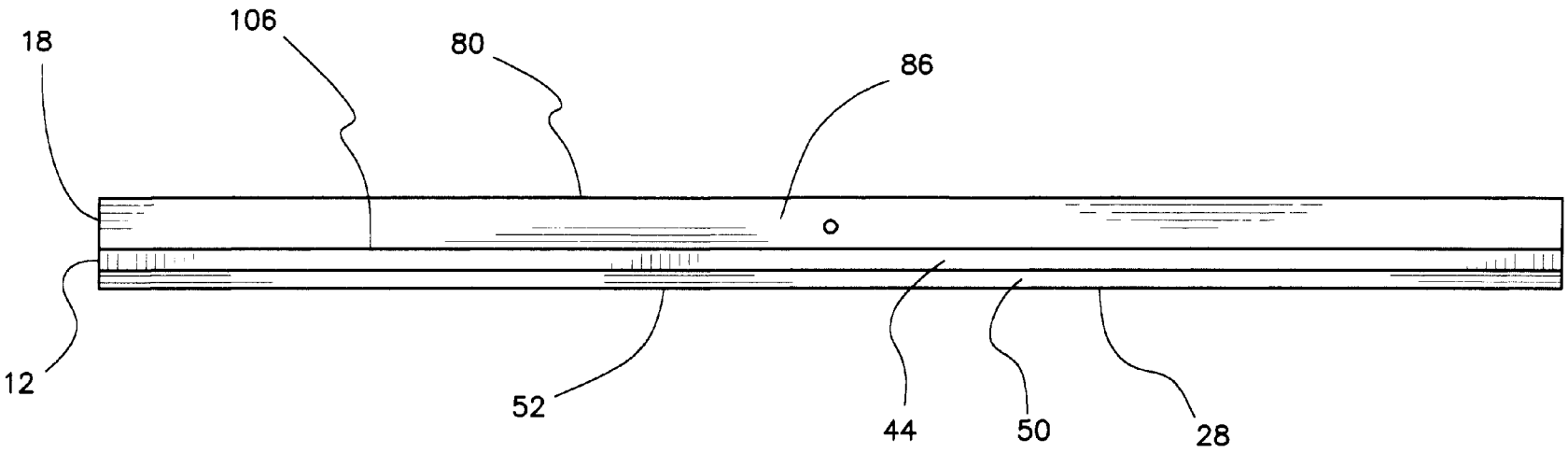
FIG. 5 is a back elevation view of the compensation device depicted in FIG. 2.
Figure 9:
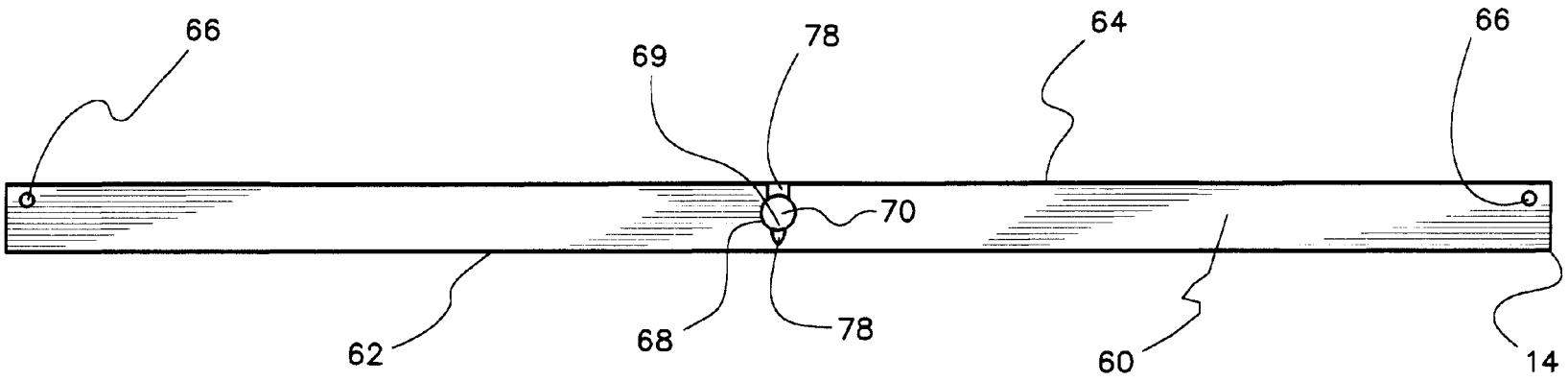
FIG. 9 is a top elevation view of an elongated wedge member of the compensation device depicted in FIG. 2 in accordance with the present invention.
Figure 10:
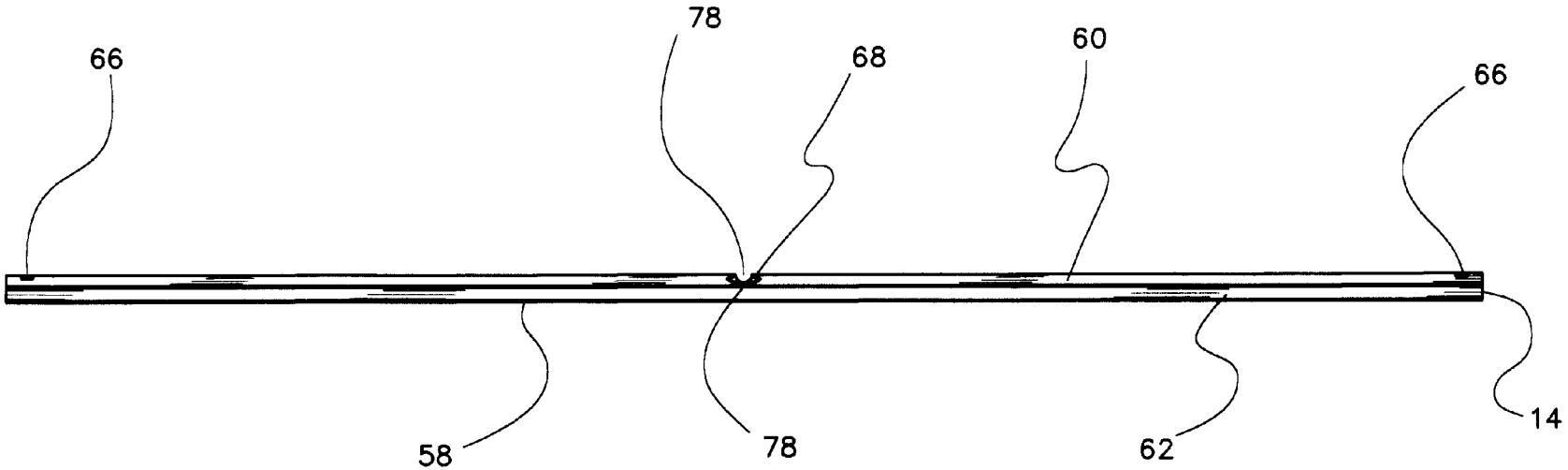
FIG. 10 is a front elevation view of the elongated wedge depicted in FIG. 9.
Figure 11:
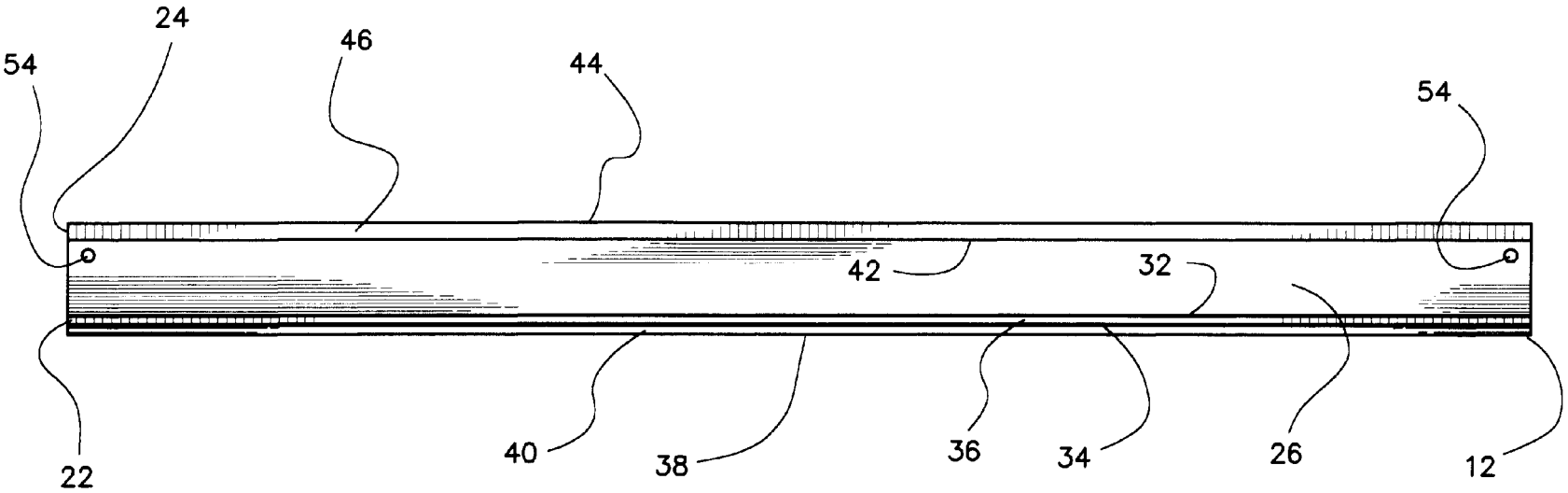
FIG. 11 is a top elevation view of a press bed engagement member of the compensation device depicted in FIG. 2 in accordance with the present invention.
Figure 12:
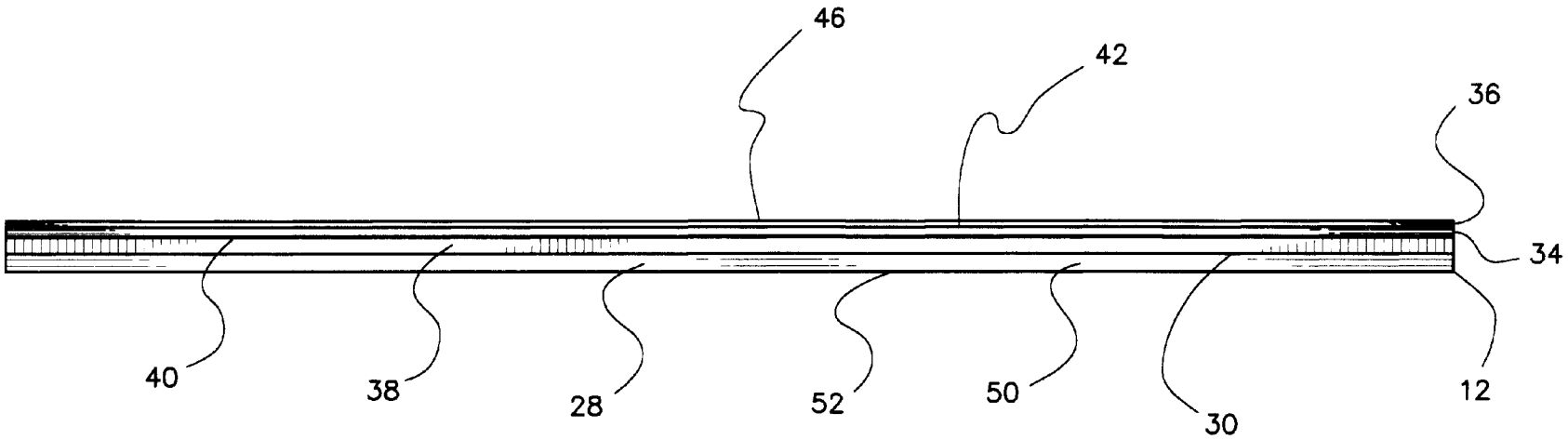
FIG. 12 is a front elevation view of the press bed engagement member depicted in FIG. 11.
Figure 13:
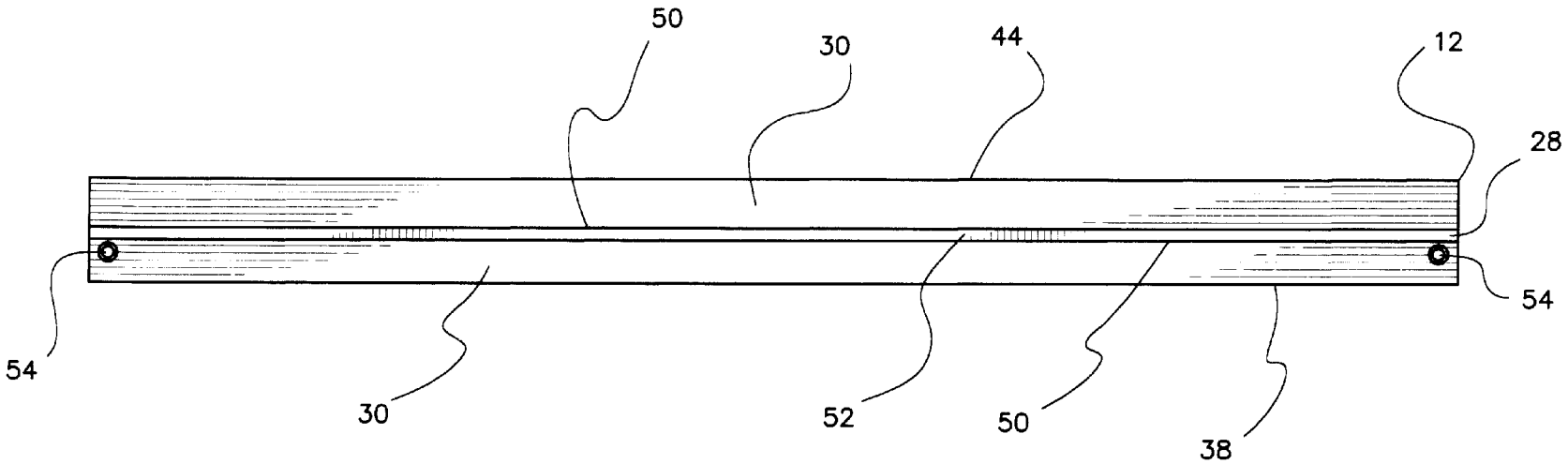
FIG. 13 is a bottom elevation view of the press bed engagement member depicted in FIG. 11.
Figure 14:
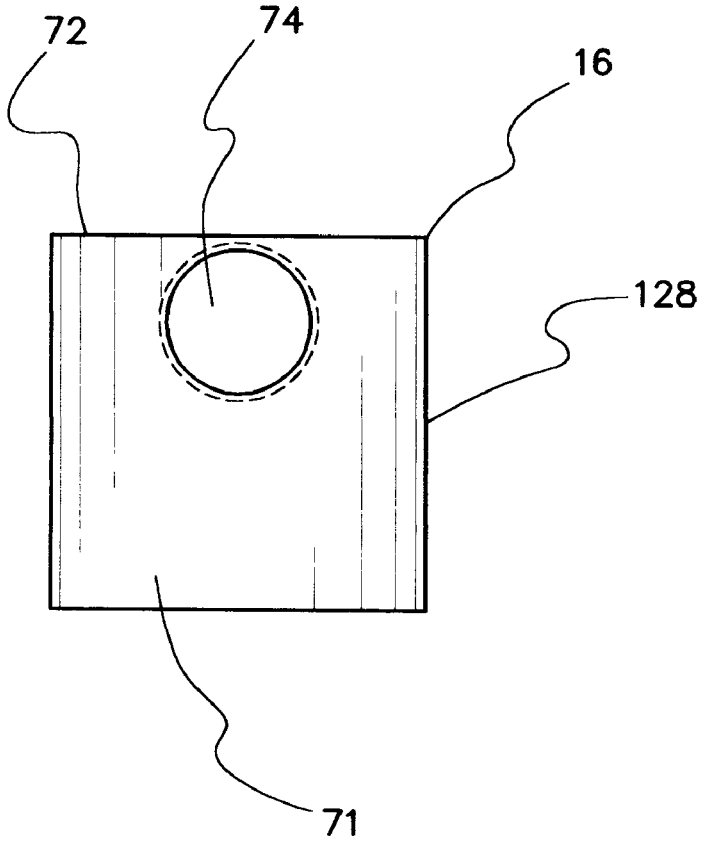
FIG. 14 is a front elevation view of the wedge deformation member of the compensation device depicted in FIG. 1 in accordance with the present invention.
Figure 15:
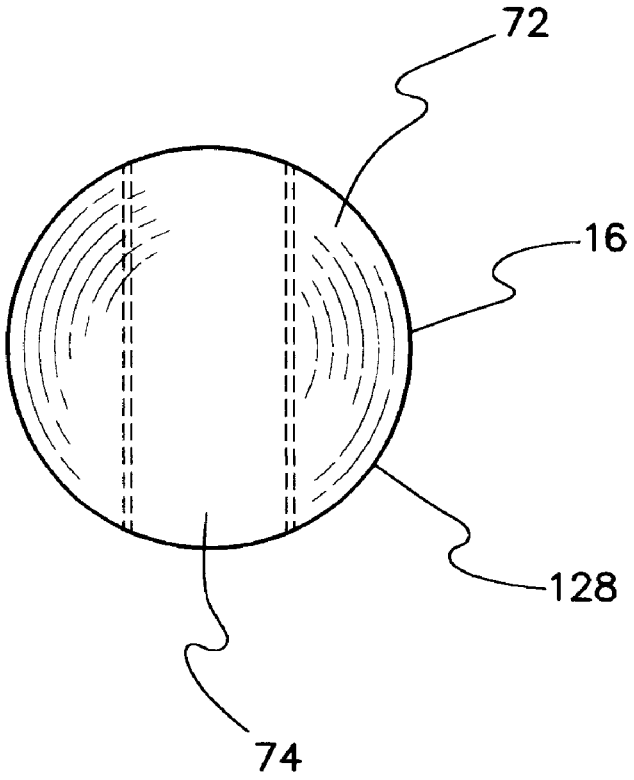
FIG. 15 is a top elevation view of the wedge deformation member depicted in FIG. 14.

Referring to FIGS. 4, 9 and 10, the elongated wedge 14 is a body of metal having a lower planar surface 58 that slidably engages the upper planar surface 26 between the first and second arm members 22 and 24 of the base member 20, an upper planar surface 60 that is inclined in relation to the lower planar surface 58 at an acute angle of substantially about ten degrees, a first side wall 62 that is perpendicular to the lower surface 58 and has a lateral dimension relatively larger than that of the inner wall 32 of the first arm member 22, and a second side wall 64 that is perpendicular to the lower surface 58 and has a lateral dimension relatively larger than that of the inner wall 42 of the second arm member 24. The wedge 14 includes two orifices 66 positioned at opposing end portions; the orifices 66 being dimensioned to congruently align with the corresponding orifices 54 in the press bed engagement member. The inclined upper surface 60 of the wedge 14 further includes a deformation recess 68 having a central axis that extends perpendicular to the lower surface 58 and to a depth that positions a bottom wall 70 of the recess 68 parallel and substantially adjacent to the lower surface 58. The recess 68 is positioned at a longitudinal mid-portion of the wedge 14, and at a relatively shorter distance from the second side wall 64 of the wedge 14 as compared to the distance from the first side wall 62 of the wedge 14.

Referring to FIGS. 1, 4A, 9, 10, 14 and 15, the recess 68 in the elongated wedge 14 is configured to snugly receive a lower portion 71 of the wedge deformation member 16 such that an upper surface 72 of the deformation member 16 is elevated above the inclined upper surface 60, a distance sufficient to allow a threaded orifice 74 to extend through the deformation member 16 and above the inclined surface 60 of the wedge 14, such that the central axis of the orifice 74 perpendicularly intersecting the central axis of the deformation member 16. A threaded wedge deformation bolt 76 is ultimately countersunk into and through the orifice 74 upon assembly of the device 10. A bolt recess 78 extends transversely in relation to the wedge 14 such that a relatively large portion of the bolt recess 78 extends from the recess 68 to the second side wall 64 of the wedge 14, and a relatively small portion of the bolt recess 78 joins with an opposing side of the recess 68. The bolt recess 78 non-engagingly receives the deformation bolt 76, thus allowing the bolt 76 to horizontally extend through the die holder member 18 and wedge deformation member 16 without engaging the inclined surface 60 of the elongated wedge 14 when the device 10 is assembled and operated.

The recess 68 includes a deformation member engagement wall 69 having a cylindrical surface area that engages a corresponding surface area of the lower portion 71 of the deformation member 16 when the member 16 is forcibly moved in a lateral direction by the deformation bolt 76 to elevate the die holder member 18. The relatively large surface area of engagement of the wall 69 receiving the bending force from the deformation member 16 urges a correspondingly sized mid-portion of the wedge 14 into a bent or "bowed" configuration which correspondingly bends the remaining portions of the wedge 14 such that the wedge resiliency parameters are maintained, thus preventing the wedge 14 from becoming permanently deformed and allowing the wedge 14 to return to its original lineal position upon "loosening" the deformation bolt 76.

Referring now to FIGS. 3, 4, 5, 8, and 8A, the die holder member 18 is an elongated body of metal having a longitudinal dimension substantially equal to the longitudinal dimension of the wedge 14. The die holder member 18 includes an upper planar surface 80 substantially parallel to the upper planar surface 26 of the base member 20, an inclined lower planar surface 82 configured to congruently engage the inclined upper planar surface 60 of the elongated wedge 14, a first side wall 84 substantially coplanar with the first side wall 38 of the base member 20, and a second side wall 86 parallel to and laterally displaced from the first side wall 84. The second side wall 86 is separated from the first side wall 84 a distance that positions an inner wall 88 of an outer arm member 90 in communication with the outer wall 44 of the second arm member 24 of the base member 20; and that positions an inner wall 92 of an inner arm member 94 in communication with the outer wall 34 of the first arm member 22 of the base member 20 thereby allowing the press bed engagement member 12 to snugly insert into a channel or recess 96 formed by the outer and inner arm members 90 and 94 of the die holder member 18.

The upper planar surface 80 of the die holder member 18 includes an elongated die receiving recess 98 extending longitudinally across a mid-portion of the upper surface 80. The recess 98 is configured to snugly receive a corresponding portion of a die (not shown), thus stabilizing the die during operation of the press brake. The first side wall 84 integrally joins to the upper surface 80 at a substantially right angle, and extends a lateral distance that positions a bottom wall 100 of the inner arm member 94 adjacent to the ledge 40 of the base member 20 such that a relatively small gap 102 is maintained between the inner arm member 94 and the base member 20 irrespective of any reduction of length of the side walls 62 and 64 of the wedge 14. The lengths of the side walls 62 and 64 of the wedge 14 determines the size of a gap 103 positioned between the inclined lower surface 82 and the upper wall 36 of the first arm member 22. The inner wall 92 of the inner arm member 94 integrally joins with the bottom wall 100 to form a right angle, and with the inclined lower surface 82 to form an acute angle that allows the congruent engagement of the inclined lower surface 82 and the inclined upper surface 60 of the elongated wedge 14. The inner wall 88 of the outer arm member 90 integrally joins with a bottom wall 106 to form a right angle, and integrally joins with an arcuate portion 104 that cooperates with the inclined lower surface 82 to form a space 108 between the inclined lower surface 82 and the upper wall 46 of the second arm member 24. The gaps 102 and 103, and the space 108 cooperate to allow the lengths of sides 62 and 64 of wedge 14 to vary a predetermined dimension thereby allowing the separation distance between the press bed engagement member 12 and the die holder member 18 to correspondingly vary, thus increasing the range of operation of the integrated device 10 and press brake.

Referring to FIGS. 4, 4A, 4B, 8, and 8A, the die holder member 18 further includes an elongated recess 112, two threaded cylindrical recesses 114 positioned at opposing end portions in the inclined lower surface 82, a plurality of threaded die retaining orifices 116 in the first side wall 84 of the die holder member 18, a deformation bolt receiving orifice 118 and a locking bolt recess 120. The elongated recess 112 extends laterally across the inclined lower surface 82 between the outer and inner arm members 90 and 94 at a longitudinal mid-portion of the die holder member 18. The elongate recess 122 includes semi-circular configured opposing ends 124 integrally joined to corresponding parallel, longitudinal walls 126 to form and dimension the recess 112 to snugly receive a relatively small upper cylindrical portion 128 of the wedge deformation member 16 to laterally guide the wedge deformation member 16 as the member 16 is forcibly moved inside the device 10.

The two threaded cylindrical recesses 114 extend from the inclined lower surface 82 to the upper surface 80; and are orientated and dimensioned to coaxially and congruently align with the corresponding orifices 66 in the opposing end portions of the elongated wedge 14. The die retaining orifices 116 are spaced apart substantially the same distance, lineally aligned, and separated from the upper surface 80 such that the central axes of the orifices 116 extend parallel to the upper surface 80 a distance that joins the orifices 116 with the die receiving recess 98 in the upper surface 80 thereby allowing threaded, countersunk die retaining bolts 130 to be inserted into and through the orifices 116 until the bolts 130 engage the die thus securing the die in the receiving recess 98.

The deformation bolt receiving orifice 118 is unthreaded, except for a threaded end portion 119 adjacent to the second side wall 86 of the die holder 18. The orifice 118 extends laterally through the longitudinal mid-portion of the die holder member 18 from the first side wall 84, through the elongated recess 112, to the second side wall 86 such that the central axis of the orifice 118 is perpendicular to both side walls 84 and 86, and parallel to the longitudinal walls 126 of the recess 112. The orifice 118 is configured to congruently and axially align with the threaded orifice 74 in the wedge deformation 16 to allow the wedge deformation bolt 76 to engage the wedge deformation member 16 when inserted through the orifice 118. The end of the bolt 76 ultimately engages a locking set screw 121 secured in corresponding threaded end portion 119 of the orifice 118. The locking set screw 121 secures and stabilizes the relative position of the inserted wedge deformation bolt 76 when the bolt 76 is rotated in a tightening direction to laterally displace the deformation member 16. Although the only threads engaging the bolt 76 are the deformation member orifice threads 74, the bolt 76 remains in a fixed position due to the bias from the deformation member 16 in the deformed wedge 14, and the continual engagement between the end of the bolt 76 and the locking set screw 121.

The locking bolt recess 120 extends parallel to the deformation bolt orifice 118 from the first side wall 84 of the die holder member 18 to a relatively "shallow" depth. The recess 120 is cylindrically configured with an inner threaded wall 132 that is positioned proximally to the deformation bolt orifice 118 such that a portion of the head 136 of a threaded locking bolt 134 inserted in the recess 120, covers a relatively small portion of a countersunk head 138 of the wedge deformation bolt 76 in the deformation bolt orifice 118 thereby preventing the deformation bolt 76 from being extracted from the orifice 118 by vibrations or machine movement during operation of the press brake.

The compensation device 10 for a press brake die is assembled by positioning an elongated wedge 14 between a press bed engagement member 12 and a die holder member 18; all having longitudinal dimensions substantially equal to the longitudinal dimension of a press bed portion of a press brake. A wedge deformation member 16 is snugly inserted in the deformation recess 68 in the inclined upper surface 60 of the wedge 14 such that a threaded orifice 74 in the deformation member 16 is axially aligned with a deformation bolt receiving orifice 118 in the die holder member 18 to ultimately receive a wedge deformation bolt 76 that is locked in position by a locking bolt 134 inserted in an adjacent recess 120. The wedge 14 is placed between first and second arm members 22 and 24 of the press bed engagement member 12 such that a lower surface 58 of the wedge 14 engages an upper surface 26 of a base member 20 of the die holder member 18; a second side wall 64 of the wedge 14 engages an inner wall 42 of the second arm member 24; and the wedge deformation member 16 is inserted in an elongated recess 112 in an inclined lower surface 60 of the die holder member 18. The die holder member 18 is set upon the wedge 14 such that the inclined lower surface of the die holder member 18 congruently engages an inclined upper surface 60 of the wedge 14, and inner walls 92 and 88 of inner and outer arm members 94 and 90 of the die holder member 18 snugly engage corresponding upper portions of outer walls 34 and 44 of first and second arm members 22 and 24 of the press bed engagement member 12. Orifices 54 and 66 in respective opposing ends of the press bed engagement member 12 and the wedge 14, are axially aligned with corresponding threaded recess 114 in the die holder member 18 to removably receive threaded bolts 56 thereby securing together the aforementioned component parts of the compensation device 10.

The assembled compensation device 10 has the upper surface 80 of the die holder member 18 parallel to the lower surface 30 of the press bed engagement member 12. The assembled device 10 is integrated with the pressing operation by installing the press bed engagement member 12 upon the press bed of the press brake, inserting a die in the die holder member 18, screwing die retaining bolts 130 into die retaining orifices 116 until forcefully engaging and thus securing the die, and placing a workpiece in the die to be forcibly bent into a predetermined configuration by the press brake. However, when a workpiece reaches a length that extends longitudinally across the entire press bed (as much as twelve feet in some press brakes), a flat spot may appear in the longitudinal mid-portion of the workpiece if the compensation device 10 is not correctly adjusted.

Figure 6:
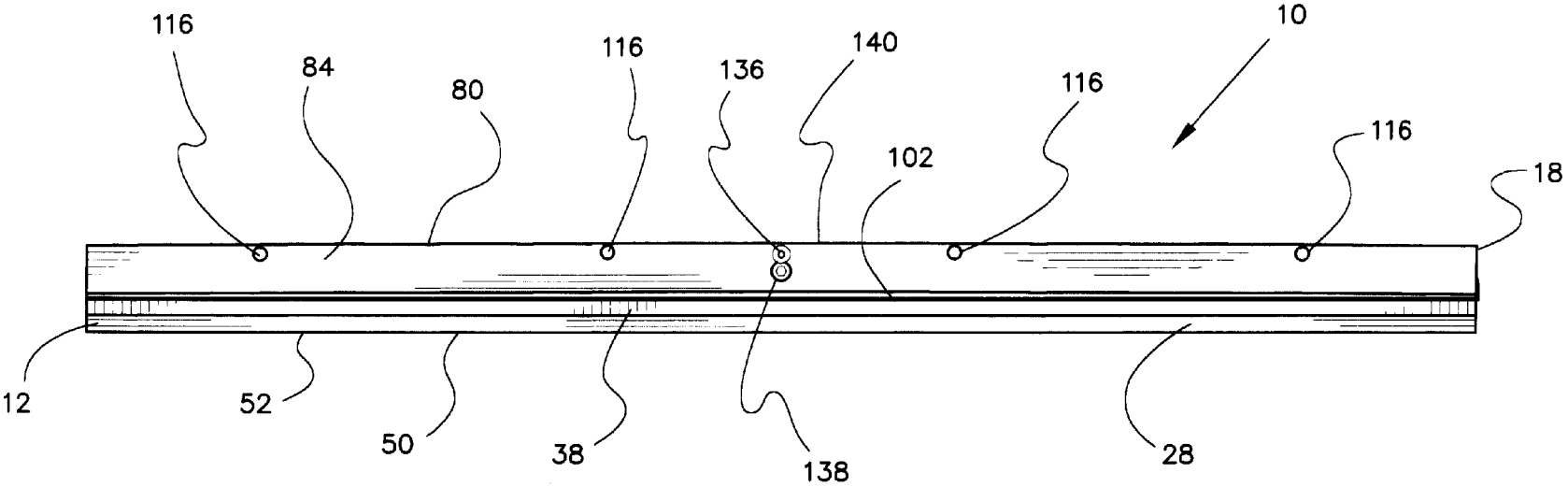
FIG. 6 is a front elevation view of the compensation device depicted in FIG. 2, having an upper surface arcuately elevated in accordance with the present invention.
Figure 7:
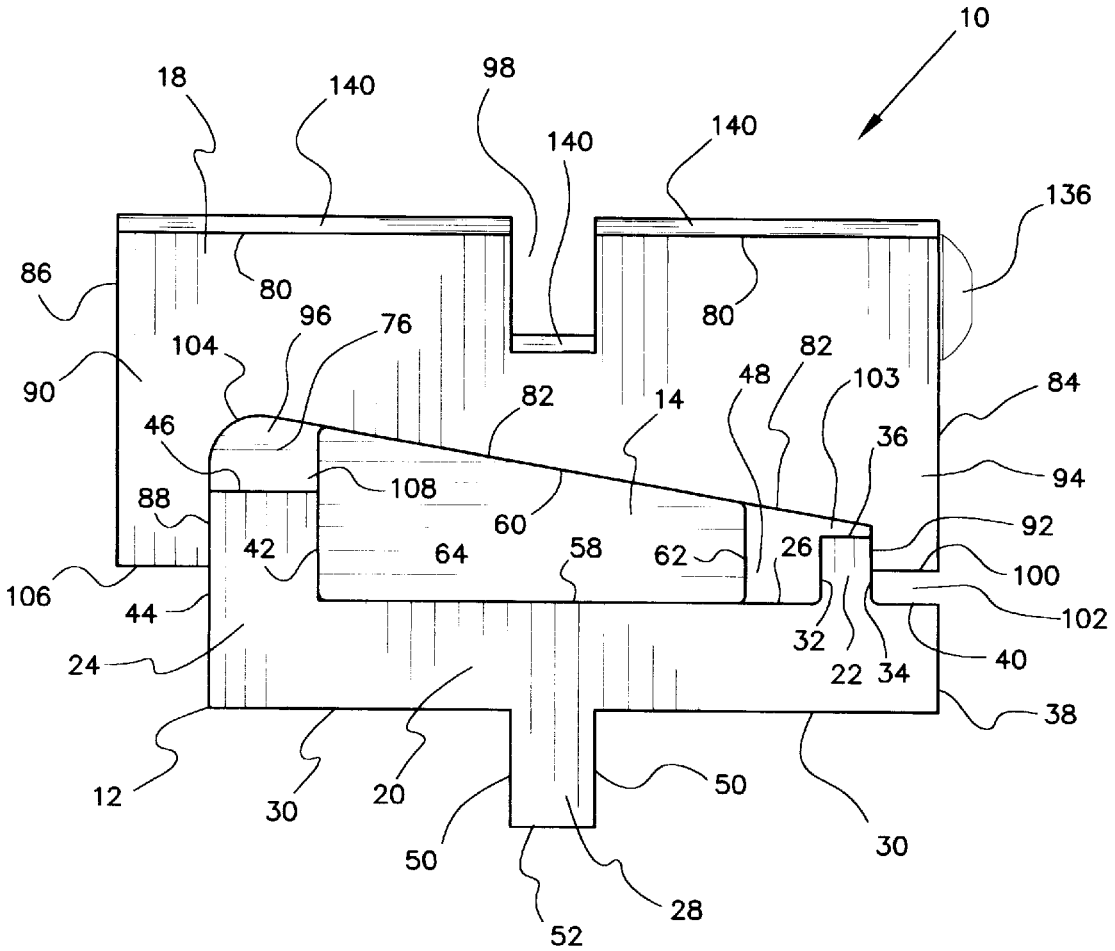
FIG. 7 is a side elevation view of the compensation device depicted in FIG. 6.
Figure 8:
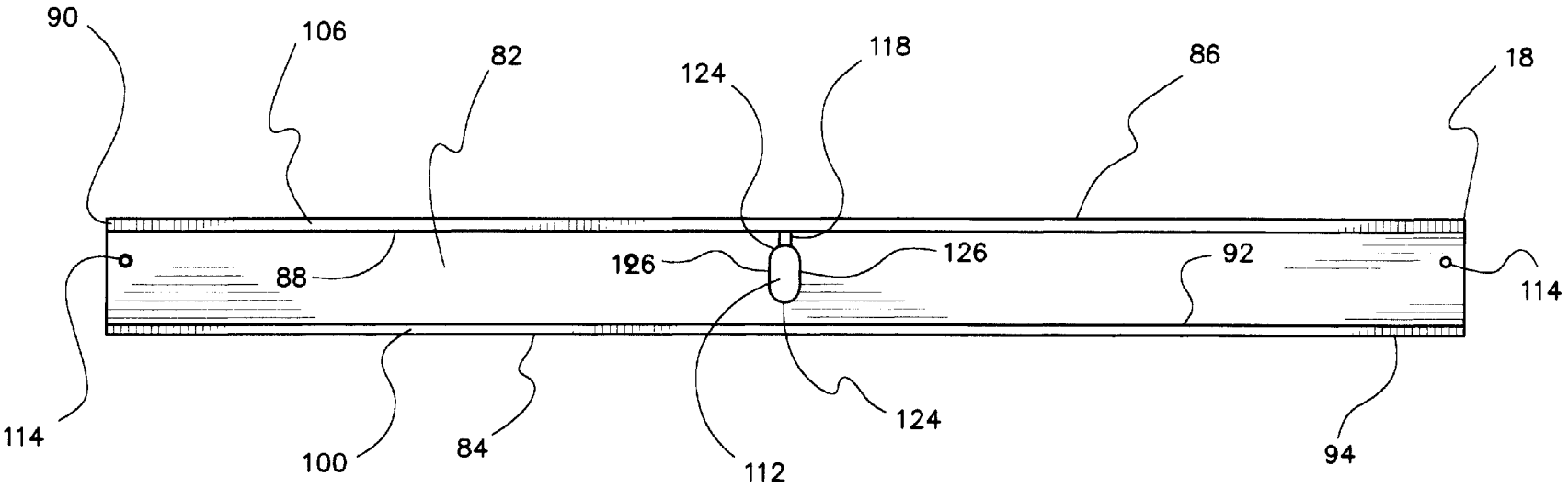
FIG. 8 is a bottom elevation view of a die holder member of the compensation device depicted in FIG. 2 in accordance with the present invention.
Figure 8A:
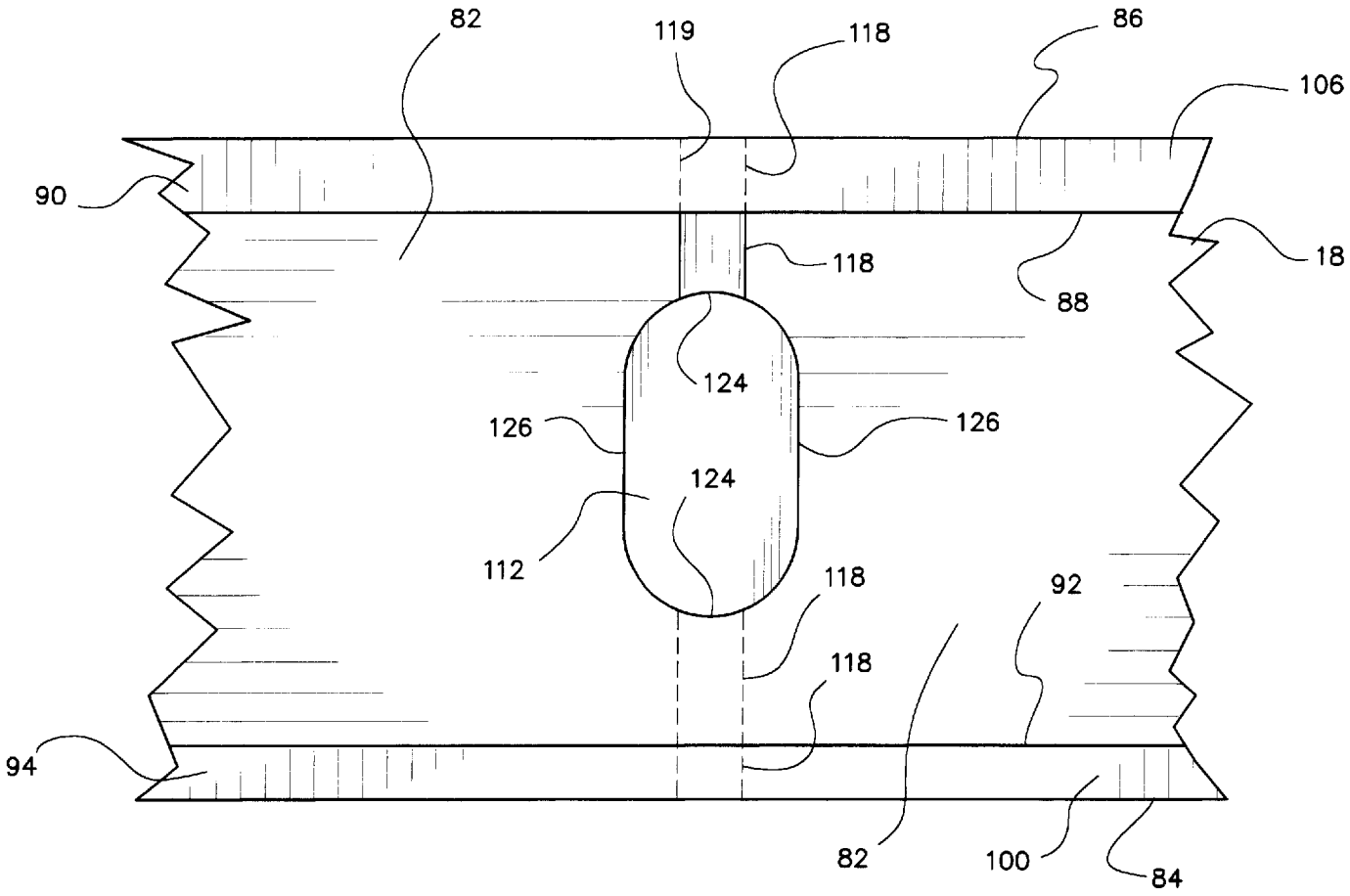
FIG. 8A is a phantom view of the mid-portion of FIG. 8 depicting the deformation bolt receiving orifice and elongated recess.
Figure 16:
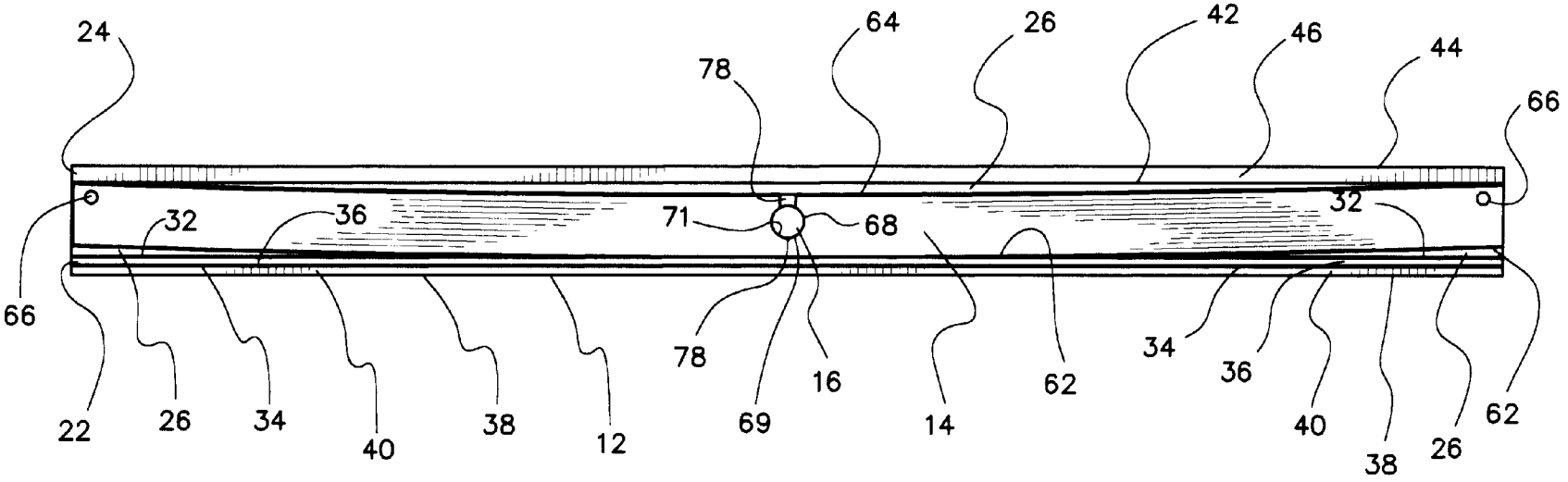
FIG. 16 is a top elevation view of a "bowed" elongated wedge and deformation member positioned in the press bed engagement member in accordance with the present invention.
Figure 17:
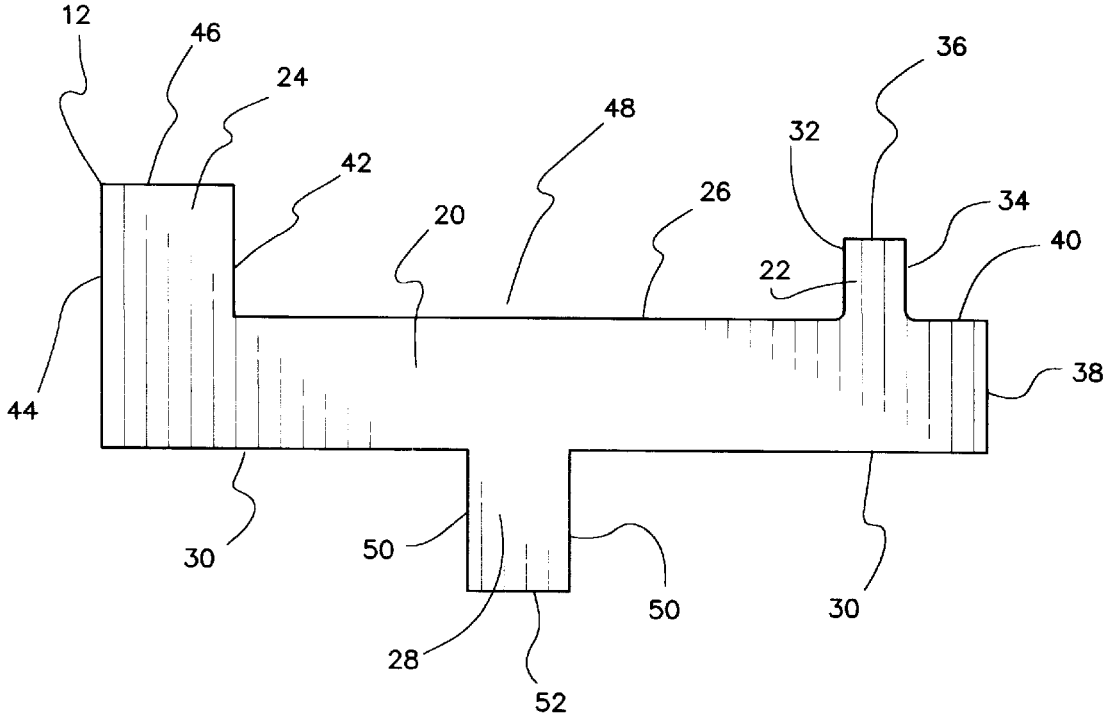
FIG. 17 is a side elevation view of the press bed engagement member depicted in FIG. 11.
Figure 18:
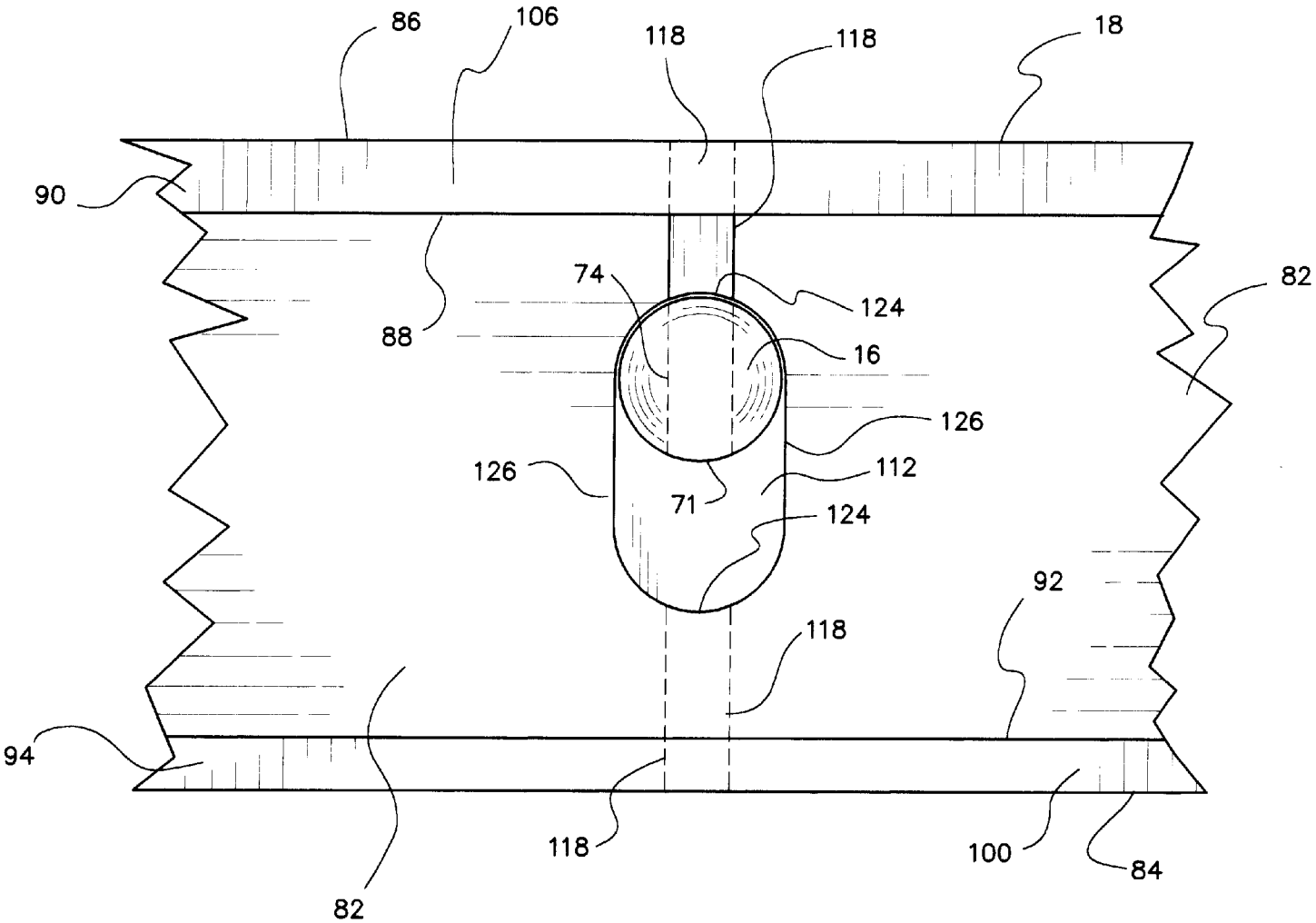
FIG. 18 is a bottom elevation view of the die holder member having the top surface of the deformation member inserted in the elongated recess in a start position in accordance with the present invention.
Figure 19:
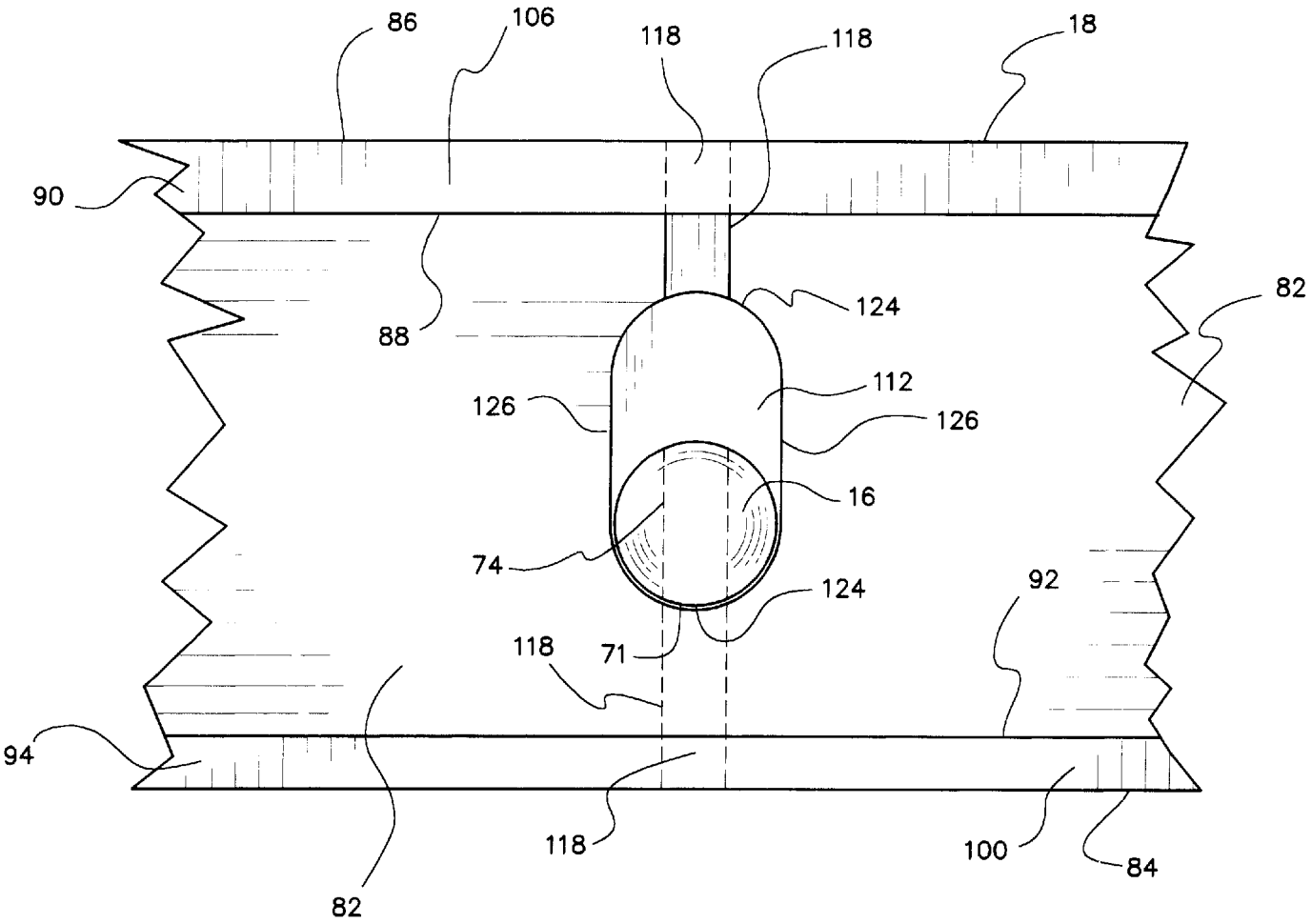
FIG. 19 is a bottom elevation view of the die holder member having the top surface of the deformation member inserted in the elongated recess in an operating position that elevates the die holder member in accordance with the present invention.

The compensation device 10 is adjusted by first knowing the length of the flat spot in relation to the length of the workpiece when the compensation device 10 is not used, then empirically determining the required elevation of the die holder member 18 to eliminate the flat spot. The device 10 is then adjusted by rotating the deformation bolt 76 in a tightening direction to move the deformation member 16 from a "start" position to an "operating position" (see FIGS. 18 and 19) until the deformation member 16 forcibly moves the mid-portion of the wedge 14 to a predetermined, displaced laterally position near the first arm member 22 of the base member 20. The restrained opposing ends of the wedge 14 cooperate with the laterally moving deformation member 16 to "bow" (see FIG. 16) the wedge 14 in the direction of the first arm member 22. The congruently engaged, oppositely angled, inclined surfaces 60 and 82 of the wedge 14 and die holder member 18, cooperate to force the die holder member 18 to correspondingly arc or elevate with the bowing of the wedge 14 thereby forming a predetermined crown 140 (see FIGS. 6 and 7) upon the upper surface 80 of the die holder 18. The elevated die holder member 18 arcuately positions the die and workpiece which prevents flat spots from forming in the workpiece when configured by the press brake. To position the die holder member 18 at the correct elevation, a feeler gauge is used to measure the dimension of the gap 102 between the bottom wall of the inner arm member 94 and the ledge 40 of the base member 20. Only the mid-portion of the gap 102 need be measured to ensure that the die holder member 18 is arcuately positioned and at the correct elevation. Upon completing the operation of the press brake to configure a consistently bent workpiece without flat spots, the wedge 14 is easily returned to its original configuration by "loosening" the deformation bolt 76 thereby allowing resilient internal straightening forces of the wedge 14 to lineally position the wedge 14.

The dimensions of the device 10 must be empirically determined to correctly crown or arcuately elevate the die holder member 18 and elevate the preselected workpiece in the press brake to a position that prevents flat spots. However, when working with a workpiece that substantially spans the standard twelve foot press bed, an acute angle dimension of substantially about ten degrees, which establishes the downward slope of the upper inclined surface 60 of the wedge 14 toward the first arm member 22, together with the congruently engaged upward slope of the lower inclined surface of the die holder member 18 toward the second arm member 24; a wedge lower surface 58 lateral dimension of substantially about two and three-eighth inches; a wedge second side wall 64 lateral dimension of substantially one inch; and a lateral movement capability for the mid-portion of the wedge 14 of substantially about one-half inch, are sufficient for eliminating flat spots that occur when configuring a workpiece in the standard press brake without a compensation device 10.

Although the aforementioned device 10 has been detailed to engage the entire longitudinal dimension of the press bed, a series of devices 10 could be used to longitudinally extend across the entire press bed. For example, lineally placing three, four foot devices end to end across a twelve foot press bed, replaces one twelve foot device 10. Obviously, this provides the capability of having three separate elevated "crowns" in a die holder member 18; one crown at a mid-portion, and one crown two feet from each end. However, because of the shortened longitudinally dimension of the devices 10, the shortened wedge 14 cannot physically "bow" to the same laterally dimension as with a twelve foot length thereby limiting the corresponding elevation of the three crowns, which could result in flat spots in corresponding portions of the workpiece.

The foregoing description is for purposes of illustration only and is not intended to limit the scope of protection accorded this invention. The scope of The foregoing description is for purposes of illustration only and is not intended to limit the scope of protection accorded this invention. The scope of protection is to be measured by the following claims, which should be interpreted as broadly as the inventive contribution permits.

What is claimed is:

1. A single adjustment compensator device for a press brake die comprising:

an elongated wedge;

a wedge deformation member;

a die holder member having a recess therein for receiving an inclined planar surface of said elongated wedge, said recess having a lateral dimension relatively larger than the lateral dimension of said elongated wedge;

a press bed engagement member having a recess therein for receiving a planar surface of said elongated wedge, said recess having a lateral dimension relatively larger than the lateral dimension of said elongated wedge;

said elongated wedge, die holder member, and press engagement member having comparable longitudinal dimensions;

means for removably securing said deformation member to said elongated wedge;

means for securing opposing end portions of said elongated wedge to cooperating end portions of said press bed engagement member and said die holder member; and means for moving said deformation member transversely to said press bed engagement member while said deformation member is removably secured to said elongated wedge, and while said opposing end portions of said elongated wedge are secured to, said cooperating end portions of said press bed engagement member and said dic holder member.

2. The device of claim 1 wherein said elongated wedge has an inclined upper planar surface and a relatively horizontal lower planar surface.

3. The device of claim 2 wherein said inclined upper planar surface forms an acute angle with said lower planar surface.

4. The device of claim 1 wherein said deformation member has a cylinder configuration.

5. The device of claim 1 wherein said removable securing means includes a recess in said inclined upper planar surface of said elongated wedge, dimensioned to snugly receive a lower portion of said cylindrically configured deformation member.

6. The device of claim 1 wherein said end portion securing means includes threaded bolts inserted through orifices in said end portions of said press bed engagement member and elongated wedge, said bolts being screwed into threaded orifices in said die holder member.

7. The device of claim 1 wherein said deformation member moving means comprises:

a threaded orifice through said deformation member;

a threaded moving bolt screwed through said threaded orifice; and means for maintaining the position of said moving bolt relative to said die holder member while said moving bolt is rotated to correspondingly move said deformation member.

8. The device of claim 1 wherein said recess of said die holder member includes a deformation member guiding slot.

9. The device of claim 8 wherein said slot includes a lateral dimension that allows an upper portion of said deformation member to snugly insert into said slot.

10. The device of claim 8 wherein said slot includes a longitudinal dimension that extends said slot transversely across said recess of said die holder member.

11. The device of claim 1 wherein said die holder member includes a die receiving recess and means for securing a die in said die receiving recess.

12. The device of claim 1 wherein said press bed engagement member includes means for maintaining the lateral position of said die holder member relative to said press bed engagement member.

13. The device of claim 12 wherein said lateral position maintaining means includes two inner longitudinal side walls of said die holder member engaging two corresponding outer longitudinal side walls of said press bed engagement member.

14. The device of claim 13 wherein said engaging longitudinal side walls of said die holder member and of said press bed engagement member, include lateral engagement dimensions that maintain contact between said longitudinal side walls irrespective of the lateral position of said deformation member.

15. An adjustable compensator device for a press brake die comprising:

a press bed engagement member;

a die holder member having means for removably receiving a die;

means for elevating an elongated die receiving portion of said die holder member in relation to said press bed engagement member;

means for adjusting the elevation of said elongated die receiving portion of said die holder member, said adjusting means requiring only one manual adjustment to adjust the elevation of said elongated die receiving portion;

means for removably combining said press bed engagement member, said elevating means and said die holder member; and means for removably joining said adjusting means to said elevating means whereby one manual adjustment forcibly positions said elongated die receiving portion in a substantially convex, arcuate configuration in relation to said press bed engagement member thereby maintaining a constant bend formed in a workpiece by a press brake.

16. The device of claim 15 wherein said elevating means includes an elongated wedge having an inclined planar upper surface, a planar lower surface, a longitudinal dimension comparable to the longitudinal dimension of said die holder member and a lateral dimension relatively smaller than the lateral dimension of a wedge receiving recess in said press bed engagement member.

17. The device of claim 15 wherein said adjusting means includes a deformation member and means for removably securing said deformation member to said elongated wedge.

18. The device of claim 17 wherein said deformation member includes a cylindrical configuration.

19. The device of claim 17 wherein said securing means includes a cylindrical recess in said inclined upper surface of said elongated wedge, said cylindrical recess having a configuration that snugly receives a lower portion of said deformation member therein.

20. The device of claim 15 wherein said combining means includes an elongated recess in said press bed engagement member that removably receives said elongated wedge therein, an elongated recess in said die holder member that removably receives said press bed engagement member and said elongated wedge therein, and means for securing opposing end portions of said elongated wedge to cooperating opposing end portions of said die holder member and said press bed engagement member.

21. A method for compensating a press brake die comprising the steps of:

providing an elongated wedge having predetermined longitudinal and lateral dimensions;

providing a press bed engagement member having a longitudinal dimension substantially equal to the longitudinal dimension of said elongated wedge;

providing a die holder member having a longitudinal dimension substantially equal to the longitudinal dimension of said elongated wedge;

combining said elongated wedge, press bed engagement member, and die holder member such that said elongated wedge is positioned between said press bed engagement member and die holder member;

securing opposing end portions of said elongated wedge to cooperating end portions of said press bed engagement member and said die holder member; and deforming said elongated wedge with one manual adjustment member whereby said die holder member is forcibly deformed between said secured end portions to form a substantially convex, arcuate configuration in relation to said press bed engagement member, to maintain a straight bend in a workpiece being configured by a press brake.

* * * * *